United States Patent [19]

Connerney et al.

[11] Patent Number: 4,952,894

[45] Date of Patent: Aug. 28, 1990

[54] WAVEGUIDE FEED NETWORK FOR ANTENNA ARRAY

[75] Inventors: William R. Connerney, Needham; Jaffar W. Hamandi, Pepperell, both of Mass.

[73] Assignee: Raytheon Company, Lexington, Mass.

[21] Appl. No.: 377,390

[22] Filed: Jul. 10, 1989

[51] Int. Cl.[5] ..... H01P 5/18

[52] U.S. Cl. ..... 333/113; 333/114; 343/776; 343/778

[58] Field of Search ..... 333/109, 113, 114, 125, 333/137; 343/771, 776, 778

[56] References Cited

U.S. PATENT DOCUMENTS 2,667,620 1/1954 Riblet ..... 333/114

3,518,576 6/1970 Algeo ..... 333/114

*Primary Examiner*—Paul Gensler

*Attorney, Agent, or Firm*—Donald F. Mofford; Denis G. Maloney; Richard M. Sharkansky

[57] ABSTRACT

An improved corporate feed network for distributing radio frequency energy to elements of an antenna array is shown. The corporate feed network comprises an improved feed coupler, including a quadrature hybrid junction for dividing radio frequency (R.F.) energy from an input port into the two waveguides and a plurality of secondary waveguides disposed orthogonally to the first and second waveguides, each of the secondary waveguides having narrow walls common to broad walls of the first and second waveguides with apertures formed through common sections of such walls, the common sections being offset to impart directional characteristics to the corporate feed network.

5 Claims, 2 Drawing Sheets

WAVEGUIDE FEED NETWORK FOR ANTENNA ARRAY

This invention was made with Government support under Contract No. DAAH01-84-C-A216 awarded by the Department of the Army. The Government has certain rights in this invention.

BACKGROUND OF THE INVENTION

This invention pertains generally to microwave feed networks, and more particularly to microwave feed networks using waveguides to distribute radio frequency energy to elements of an antenna array.

A corporate feed network for an antenna array typically uses waveguides and waveguide junctions to distribute radio frequency (R.F.) energy to elements of the antenna array. A T-junction having two collinear ports and an orthogonal port may be used as a simple coupler by means of an aperture at the junction. The aperture couples a portion of the radio frequency (R.F.) energy from either of the collinear ports into the orthogonal port. Similarly, R.F. energy incident into the orthogonal port couples an equal amount of R.F. energy into the collinear ports.

Four-port junctions can be composed of two similarly shaped waveguides placed side by side, with an aperture providing the required coupling between them. When two or more appropriately spaced apertures are used between two parallel waveguides, power coupled into the secondary waveguide will propagate in only one direction, thus creating a directional coupler. Such a directional coupler is commonly called a three-decibel directional coupler, or a quadrature hybrid junction, dividing R.F. energy introduced at one port equally between two other ports and suppling little or no energy to the remaining port.

Using known coupling techniques, it is often necessary for a corporate feed network to be designed with complex twist sections and multiple bends to feed the elements of the antenna array correctly. Further, required spacing between the elements of an antenna array is often difficult to attain using known corporate feed networks. Typical four port couplers, because of their size and package form factor, may be unsuited. Three port couplers, while simplifying the complexity of a corporate feed network, compromise the performance of such a feed network. It is therefore desirable to create a coupler which, when used in combination, provides effective electrical performance, has mechanical simplicity, ease of construction, and optimum form factor packaging.

SUMMARY OF THE INVENTION

With the foregoing background of this invention in mind, it is a primary object of this invention to provide a corporate feed network for coupling R.F. energy to elements of an antenna array, such network being easily constructed to lower cost of construction.

It is another object of this invention to provide a corporate feed network for distributing R.F. energy to elements of an antenna array, such network having effective electrical performance while maintaining an optimum form factor for packaging.

It is still another object of this invention to provide a corporate feed network for distributing R.F. energy to elements of an antenna array, such network having physical simplicity for easy fabrication.

The foregoing and other objects of this invention are met generally by a corporate feed network (hereinafter sometimes referred to as a "feed network") for distributing R.F. energy using feed couplers comprising a first and a second rectangular waveguide, a quadrature hybrid junction for dividing R.F. energy fed into the first rectangular waveguide into the two waveguides, the phase of the R.F. energy in the first waveguide leading the phase of the R.F. energy in the second waveguide by ninety degrees, and a plurality of secondary waveguides, each secondary waveguide having a wall common to a wall of the first waveguide with a first aperture located therein and having an opposing wall common to a wall of the second waveguide with a second aperture located therein, the center of the first aperture being separated from a point opposite the center of the second aperture by a distance substantially equal to one-quarter of a wavelength of the R.F. energy being distributed. The coupling of R.F. energy into the secondary waveguides by opposing apertures separated by one-quarter of a wavelength changes the phase of the R.F. energy by ninety degrees as the R.F. energy travels the distance from the first aperture to the second aperture in each of the secondary waveguides, thereby creating a directional coupling effect. Since the phase of the R.F. energy coupled by the first aperture leads the phase of the R.F. energy coupled by the second aperture, the R.F. energy coupled by the first aperture will add to the R.F. energy coupled by the second aperture when the R.F. energy is traveling in the direction from the first aperture to the second aperture and the R.F. energy coupled by the first aperture will subtract with the R.F. energy coupled by the second aperture when the R.F. energy is traveling in the direction from the second aperture to the first aperture. The disclosed embodiment allows construction of a feed network not requiring complex twist sections and multiple bends while maintaining the necessary spacing required for feeding elements of an antenna array.

BRIEF DESCRIPTION OF THE DRAWINGS

For a more complete understanding of this invention, reference is now made to the following description of the accompanying drawings, wherein.

DESCRIPTION OF THE PREFERRED EMBODIMENT

Figure 1:
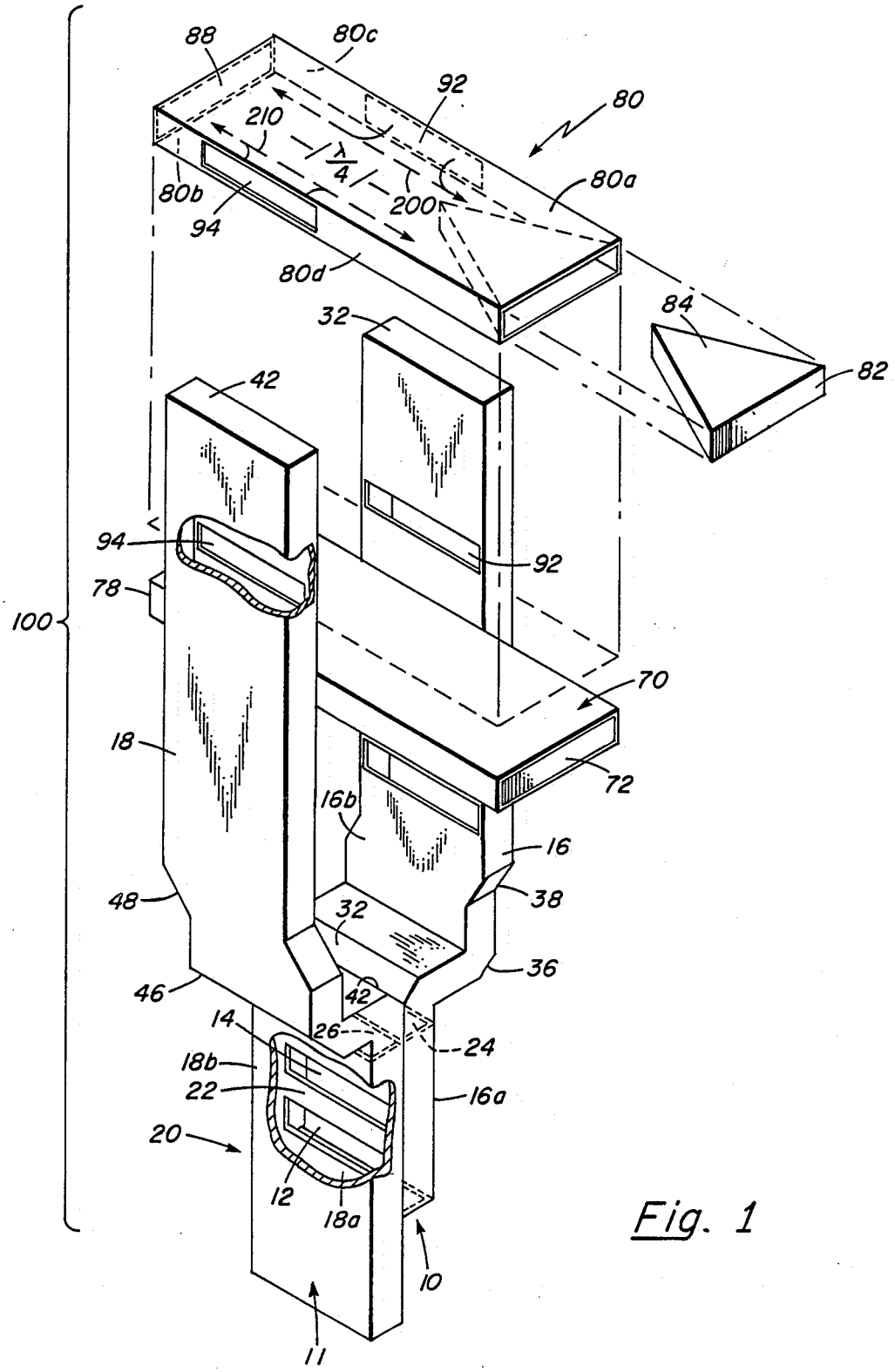
FIG. 1 is an isometric view, partially torn away, exploded, and somewhat distorted of a feed coupler according to this invention.

Referring now to FIG. 1, a feed coupler 100, as here contemplated, is shown to have an input port 10 and two output ports 78, 88. The number of output ports in practice may, and probably would be, greater, but the principles of the invention are most clearly illustrated by showing only two output ports. Feed coupler 100 includes a quadrature hybrid junction 20 for dividing R.F. energy introduced at the input port 10 into two rectangular waveguides 16, 18 to couple such R.F. energy to rectangular waveguides 70, 80 in which output ports 78, 88 are formed. The first and second broad walls of rectangular waveguide 80 are, respectively, designated **80*a* and 80*b*; the first and second narrow walls of rectangular waveguide 80 are, respectively, designated 80*c* and 80*d*. Rectangular waveguide 70** (and other corresponding rectangular waveguides, if used) have similar walls.

Input port 10 is fed R.F. energy from a source (not shown). Input port 10 is also the input port of a quadrature hybrid junction 20 (hereinafter sometimes referred to simply as "hybrid junction 20"). Such junction is a waveguide arrangement with four ports, which (when the ports have reflectionless terminations) has the property that energy entering at one port (here input port 10) is transferred to two (here output port 24 and output port 26) of the remaining three ports. The output ports 24 and 26 are here shown in phantom and the fourth port (designated "port 11") will be described hereinafter. Hybrid junction 20 is formed by a section of primary waveguide 16 (hereinafter also referred to as "waveguide 16,") and a section of primary waveguide 18 (hereinafter also referred to as "waveguide 18,") having a section of common wall 22 made up of overlapping sections of the broad walls **16*b*, 18*a* of waveguides 16 and 18. Aperture 12 and aperture 14 are slots formed through the common wall 22, such apertures being spaced one-quarter wavelength apart along the run of common wall 22. Radio frequency energy incident on the input port 10 and passing through waveguide 16 is then coupled through aperture 12 and aperture 14 so that equal amounts of R.F. energy are passed to the output ports 24, 26. Due to the coupling effect of aperture 12 and aperture 14, the R.F. energy at output port 24 is 90° out-of-phase with respect to the R.F. energy at output port 26. The phase of the R.F. energy here is such that the phase of the R.F. energy exiting output port 24 leads the phase of the R.F. energy exiting output port 26 by 90° . Any R.F. energy that may have been coupled toward termination port 11, the fourth port of the hybrid junction 10**, is absorbed in a manner described hereinafter. Quadrature hybrid couplers are well known in the art and one of ordinary skill in the art could readily fabricate such a coupler.

R.F. energy exiting output ports 24, 26 follows the path defined by the waveguides 16, 18, respectively. Waveguide 16 and waveguide 18 branch away from each other at bend 32, 42, respectively, thereby ending the common wall 22. Bend 32 and bend 42 are 90° double-mitered corners. A double-mitered corner is well known in the art and is not described further. Waveguide 16 and waveguide 18 branch away from each other for a distance equal to the width of the broad walls **80*a*, 80*b* of waveguide 80 which will allow a section of the rectangular waveguide 80 (and any other similar elements, as rectangular waveguide 70) to be placed between waveguide 16 and waveguide 18. Waveguide 16 and waveguide 18 then make another corner at bends 36, 46, respectively, so that waveguide 16 and waveguide 18 are then parallel to each other and separated by a distance equal to the width of broad wall 80*a* of waveguide 80. Bend 36 and bend 46 are also 90° double-mitered corners. Depending upon the proximity of the secondary waveguides to the outputs 24, 26, alternative methods could be used for separating waveguides 16 and 18**, such as a 90° circular bend or a Y-shaped configuration.

After bend 36, waveguide 16 is bent at bend 38 along the narrow wall of waveguide 16 whereby the narrow wall of waveguide 16 is displaced substantially one-eighth wavelength. After bend 46, waveguide 18 is bent at bend 48 along the narrow wall of waveguide 18 in a direction opposite that of bend 38, whereby the narrow wall of waveguide 18 is displaced substantially one-eighth wavelength. The combination of bends 38 and 48 causes the center of waveguide 16 to be separated from a point opposite the center of waveguide 18 by a distance substantially equal to one-quarter wavelength of the R.F. energy being distributed, thereby offsetting waveguides 16 and 18.

A plurality of secondary waveguides, typified by rectangular waveguides 70 and 80, are located between primary waveguide 16 and primary waveguide 18. Rectangular waveguide 80, typical of the secondary waveguides (not numbered), has an output port 88 and, at the opposite end, a termination port 82. Positioned between waveguide 16 and waveguide 18, a section of the narrow wall **80*c* of rectangular waveguide 80 is common to a section of the wide wall 16*b* of waveguide 16 and a section of narrow wall 80*d* of rectangular waveguide 80 is common to a section of the wide wall 18*a* of waveguide 18. Aperture 92 is formed through each section of the common walls of waveguide 16 and rectangular waveguide 80 to couple R.F. energy from waveguide 16 to waveguide 80. Aperture 92 is a slot formed in the center of the section of the narrow wall of rectangular waveguide 80 with the direction of the longitudinal axis of the slot parallel the longitudinal axis of rectangular waveguide 80. Aperture 94 is similarly formed in a section of the common wall between waveguide 18 and rectangular waveguide 80 to provide coupling of the R.F. energy from waveguide 18 to rectangular waveguide 80. It should be noted that, because of the offset of the waveguides 16, 18, the ends of slots 92, 94 are offset by one-quarter wavelength along the run of the rectangular waveguide 80**.

R.F. energy having a TE*10* transverse H-field in waveguide 16 is coupled through aperture 92 to create a longitudinal H-field in the rectangular waveguide 80. Aperture 92 provides only nondirectional coupling since there exists only one common field between waveguide 16 and rectangular waveguide 80. The R.F. energy having a $TE_{10}$ transverse H-field in waveguide 18 is coupled through aperture 94 to create a longitudinal H-field in the rectangular waveguide 80. Aperture 94 provides only nondirectional coupling since there exists only one common field between waveguide 18 and rectangular waveguide 80. However, the coupling from aperture 92 and the coupling from aperture 94 interact together to provide a directional feature.

Because aperture 92 is offset from the aperture 94 by one-quarter wavelength of the R.F. energy, R.F. energy propagating in rectangular waveguide 80 in the direction from aperture 92 to aperture 94 will be retarded in phase by 90° in passing from the former to the latter aperture. However, because the phase of R.F. energy 200 in waveguide 16 leads the phase of the R.F. energy 210 in waveguide 18 by 90° , the phase of the R.F. energy 200 coupled through aperture 92 into rectangular waveguide 80 from waveguide 16 is initially 90° ahead of the phase of the R.F. energy 210 coupled through aperture 94 into rectangular waveguide 80 from waveguide 18. The propagation delay of R.F. energy in rectangular waveguide 80 results in: (a) constructive interference between the R.F. energy out of the apertures 92, 94 and moving toward the output port 88; and (b) destructive interference between the R.F. energy out of the apertures 92, 94 and moving toward the termination port 82. That is to say, R.F. energy 200 will then be added to the R.F. energy 210 as the R.F. energy 200, 210, respectively, propagates toward output port 88. In contrast, when R.F. energy 210 propagates toward aperture 92, the phase of R.F. energy 210, upon reaching aperture 92, will be 180° out-of-phase with the R.F. energy 200. As a result, the R.F. energy 210 will be subtracted from the R.F. energy 200 as R.F. energy 200, 210 propagates towards termination port 82. Therefore, R.F. energy 200 will substantially cancel out the R.F. energy 210 at termination port 82. Thus, it may be seen that R.F. energy 200, 210 will substantially propagate in one direction only toward output port 88. An R.F. energy-absorbent material provides a medium to absorb any radio frequency energy that travels in the direction of termination port 82, thereby preventing any further reflection of R.F. energy 200, 210, respectively, in the rectangular waveguide 80. Thus, a wedge 84 of R.F. absorbent material is used to absorb the R.F. energy, such wedge 84 preferably having the length of two or more wavelengths. An R.F. absorbent material such as that designated MF 117 by Emerson & Cummings, Inc. of Woburn, Mass. can be used. The termination port 82 could also be constructed in a form of a card of resistance material placed transversely in the rectangular waveguide 80 one-quarter length from the metal plate capping the end of the rectangular waveguide 80 or in any other known termination method. Termination port 82 is typical of termination ports 11, 72.

As stated hereinbefore, rectangular waveguide 80 is typical of the secondary waveguides (not numbered) so that each one of the plurality of secondary waveguides is constructed in a manner similar to rectangular waveguide 80 and mounted between the waveguides 16, 18 to form a corporate feed for a linear array of antenna elements. Thus, rectangular waveguide 70 may be separated from waveguide 80 a distance effectively equal to one-half of a wavelength so that the R.F. energy in rectangular waveguide 70 is substantially 180° out-of-phase with the R.F. energy in the adjacent waveguide, rectangular waveguide 80. Additional waveguides may be similarly disposed so that the R.F. energy exiting the resulting plurality of output ports (including output ports 78 and 88) are alternately 180° out-of-phase with each other as required for feeding a linear array of antenna elements. It should be appreciated by those of skill in the art that one could modify the spacing between the additional secondary waveguides and that one could modify the amount of R.F. energy out of the output port in each secondary waveguide by varying the dimensions of each aperture the provide an amplitude taper.

Figure 2:
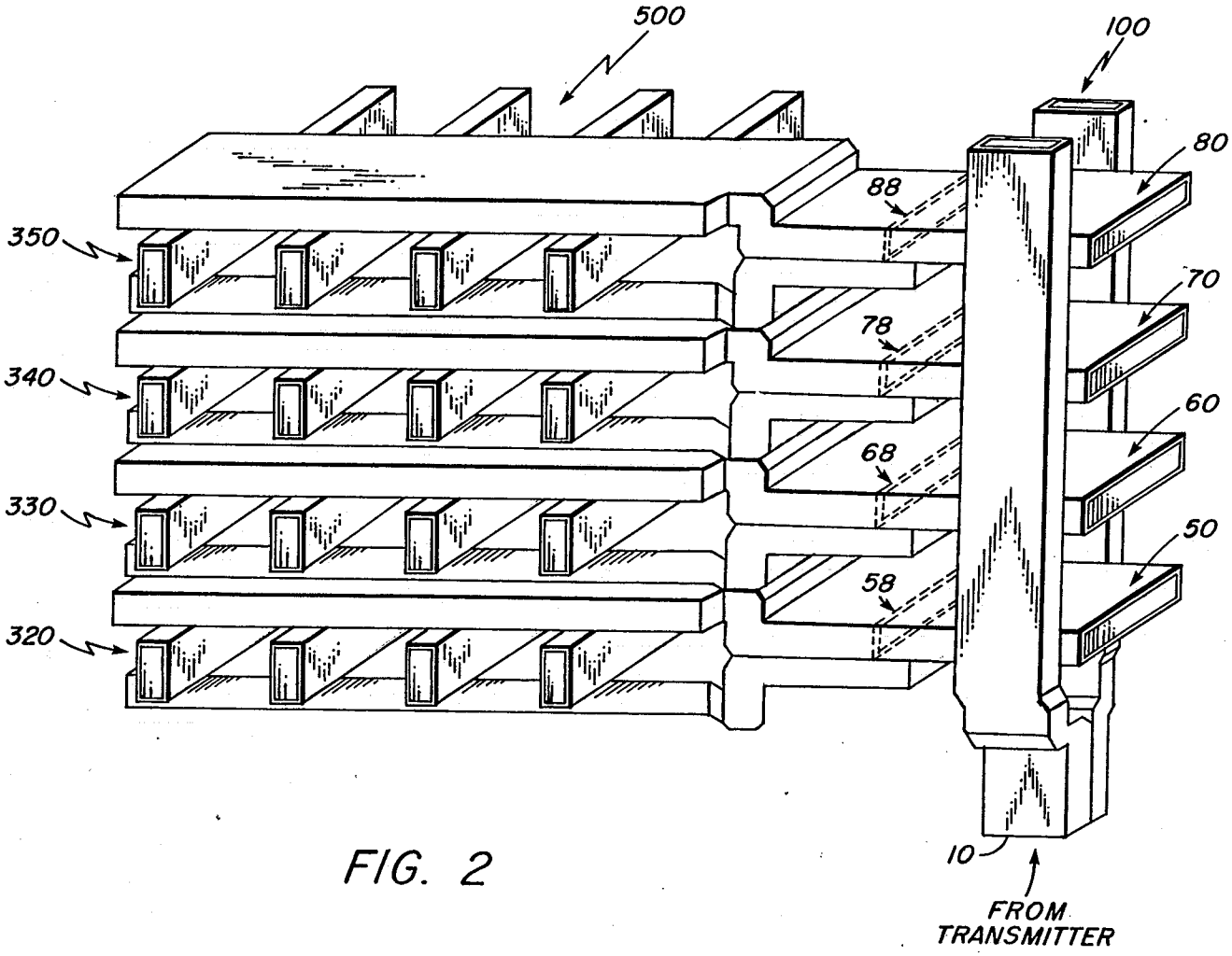
FIG. 2 is an isometric view of a feed network incorporating the feed coupler illustrated in FIG. 1.

Referring now to FIG. 2, it will be apparent to one of skill in the art that the above-described feed coupler 100 could be one of a plurality of feed couplers used in combination with each other to form a corporate feed network for a linear array of antenna elements. Thus, an illustrated antenna feed network 500 comprises a first feed coupler 100 feeding a second feed coupler 320, a third feed coupler 330, a fourth feed coupler 340 and a fifth feed coupler 350. An input signal is applied to the input port 10 and, as described hereinbefore, output signals exit output ports 88, 78, 68, 58. It will be appreciated, however, that output port 88 is also the input port for feed coupler 350 as well as output port 78 being the input port for feed coupler 340, output port 68 being the input port for feed coupler 330 and output port 58 being the input port for feed coupler 320. R.F. energy enters such input ports, and, as described hereinbefore, exit the plurality of output ports (not numbered). It should now be apparent that row and column spacing requirements of antenna arrays can now be accommodated by using the feed network disclosed. While simplifying the complexity of the feed, the design of the feed network does not compromise the electrical performance of the antenna caused by antenna element and feed coupling interactions. Meeting the phase requirements of each of the elements of the antenna array, each of the secondary waveguides can be spaced in relation to the adjacent waveguide to accommodate the element as required.

Having described this invention, it will now be apparent to one of skill in the art that the number and disposition of the various sections of waveguide may be changed without affecting this invention. It is felt, therefore, that this invention should not be restricted to its disclosed embodiment, but rather should be limited only by the spirit and scope of the appended claims.

What is claimed is:

1. A corporate feed coupler for distributing R.F. energy, such coupler including a pair of primary and a plurality of secondary waveguides, each one of such waveguide having a rectangular cross-section, with a first and a second broad wall, a first and a second narrow wall and a first and a second end, such coupler comprising:

(a) a quadrature hybrid junction formed from the pair of primary waveguides, such junction having an input port corresponding to the first end of one of the pair of primary waveguides, to divide R.F. energy applied to the input port equally between the waveguides making up the pair of primary waveguides and to impart a 90° relative phase shift between the R.F. energy in such waveguides, each one of the pair of primary waveguides further being disposed to have facing broad walls adjacent the second ends of such waveguides, the spacing between such broad walls being substantially equal to the broad wall of each one of the secondary waveguides;

(b) means for supporting each one of the secondary waveguides at a different position spaced along the facing broad walls of the pair of primary waveguides, with the narrow walls of each one of the plurality of secondary waveguides contacting corresponding sections of the broad walls of the pair of primary waveguides; and (c) an aperture formed through each contacting narrow wall of each one of the plurality of secondary waveguides and the corresponding section of the broad wall of each one of the pair of primary waveguides to couple R.F. energy from the pair of primary waveguides to each one of the plurality of secondary waveguides, the position along the length of each one of the two apertures in each one of the plurality of secondary waveguides being offset whereby constructive interference is experienced by R.F. energy out of the first end of each one of the plurality of secondary waveguides and destructive interference is experienced by R.F. energy at the second end of each one of the plurality of secondary waveguides.

2. A coupler as in claim 1 wherein the positions of the secondary waveguides along the facing broadwalls of the pair of primary waveguides are varied to control the phase of the R.F. energy out of the first end of each one of the secondary waveguides.

3. A coupler as in claim 2 wherein the dimensions of each aperture are varied to provide an amplitude taper across the first ends of the secondary waveguides.

4. A coupler as in claim 3 wherein a radio frequency absorber is disposed at each second end of each one of the primary and secondary waveguides.

5. In a corporate feed network, a coupler for distributing R.F. energy to each element in a planar array of antenna elements, such coupler including a pair of primary waveguides, a first plurality of pairs of intermediate waveguides and a second plurality of secondary waveguides, each one of all such waveguides having a rectangular crosssection with a first and a second broad wall, a first and a second narrow wall and a first and a second end, such coupler comprising:

(a) a quadrature hybrid junction formed from the pair of primary waveguides, such junction having an input port corresponding to the first end of one of the pair of primary waveguides, to divide R.F. energy applied to the input port equally between the waveguides making up the pair of primary waveguides and to impart a 90° relative phase shift between the R.F. energy in such waveguides, each one of the pair of primary waveguides further being disposed to have facing broad walls adjacent the second ends of such waveguides, the spacing between such broad walls being substantially equal to the broad wall of each one of the, intermediate waveguides;

(b) a first plurality of quadrature hybrid junctions formed from the first plurality of pairs of intermediate waveguides, each one of such junctions having an input port corresponding to the first end of one of the plurality of intermediate waveguides, to divide R.F. energy applied to the input port of each one of such waveguides equally between the waveguides making up the plurality of hybrid junctions and to impart a 90° relative phase shift between the R.F. energy in the intermediate waveguides, each one of the first plurality of pairs of intermediate waveguides being disposed to have facing broad walls adjacent the second ends of such waveguides, the spacing between such broad walls being substantially equal to the broad wall of each one of the intermediate waveguides;

(c) means, adjacent the first end of each one of the first plurality of pairs of intermediate waveguides, for supporting each one of the first plurality of intermediate waveguides at a position spaced along the facing broad walls of the pair of primary waveguides with the narrow walls of each one of the first plurality of pairs of intermediate waveguides contacting corresponding sections of the facing broad walls of the pair of primary waveguides;

(d) means, adjacent the first end of each one of the plurality of intermediate waveguides, for supporting each one of the second plurality of secondary waveguides at a different position spaced along the facing broad walls of the first plurality of intermediate waveguides, with the narrow walls of each one of the second plurality of secondary waveguides contacting corresponding sections of the facing broad walls of the first plurality of intermediate waveguides; and (e) an aperture formed through each contacting section between each one of the second plurality of secondary waveguides and the corresponding broad wall of each one of the first plurality of intermediate waveguides and an aperture formed through each contacting section between each one of the first plurality of intermediate waveguides and the pair of primary waveguides to couple R.F. energy from the pair of primary waveguides through the first plurality of intermediate waveguides to each one of the second plurality of secondary waveguides, the position of each one of the apertures between any two waveguides being such that constructive interference is experienced by R.F. energy out of the first end of any one of the first and second plurality of waveguides and destructive interference is experienced by R.F. energy at the second end of any one of the first and second plurality of waveguides.

* * * * *